US010892570B1

(12) United States Patent
Dumont

(10) Patent No.: US 10,892,570 B1
(45) Date of Patent: Jan. 12, 2021

(54) ELECTRICAL CONNECTION DEVICE FOR AN ELECTRICAL APPARATUS AND CONNECTION METHOD USING SAID DEVICE

(71) Applicant: SOCOMEC, Benfeld (FR)

(72) Inventor: Roger Dumont, Benfeld (FR)

(73) Assignee: SOCOMEC, Benfeld (FR)

( * ) Notice: Subject to any disclaimer, the term of this patent is extended or adjusted under 35 U.S.C. 154(b) by 0 days.

(21) Appl. No.: 16/772,084

(22) PCT Filed: Dec. 4, 2018

(86) PCT No.: PCT/EP2018/083457

§ 371 (c)(1),
(2) Date: Jun. 11, 2020

(87) PCT Pub. No.: WO2019/120978

PCT Pub. Date: Jun. 27, 2019

(30) Foreign Application Priority Data

Dec. 21, 2017 (FR) ..... 17 62748

(51) Int. Cl.
*H01R 4/44* (2006.01)
*H01R 4/46* (2006.01)

(52) U.S. Cl.
CPC ..... *H01R 4/44* (2013.01); *H01R 4/46* (2013.01)

(58) Field of Classification Search
CPC ... H01R 4/44; H01R 4/42; H01R 4/46; H01R 4/38; H01R 4/40
See application file for complete search history.

(56) References Cited

U.S. PATENT DOCUMENTS

2016/0226159 A1 8/2016 Stier

FOREIGN PATENT DOCUMENTS

| | | |
|---|---|---|
| CN | 206022666 U | 3/2017 |
| CN | 206180132 U | 5/2017 |
| JP | S5026388 U | 3/1975 |

*Primary Examiner* — Ross N Gushi
(74) *Attorney, Agent, or Firm* — Forge IP, PLLC

(57) ABSTRACT

An electrical connection device for an electrical apparatus includes a connection pad and two attachment flanges arranged on either side of the connection pad. The attachment flanges and the connection pad include opposing cavities for delimiting four recesses capable of receiving at most four conductors. A pass-through clamping mechanism, formed by two lateral tie rods and a central rod, passes through the assembly constituted by superposition of the attachment flanges and the connection pad. The lateral tie rods include a support abutment arranged between the connection pad and one of the attachment flanges so that it is possible to differentiate the tightening, recess by recess, facilitating the placing of the conductors, the conductors being able to have different diameters.

21 Claims, 8 Drawing Sheets

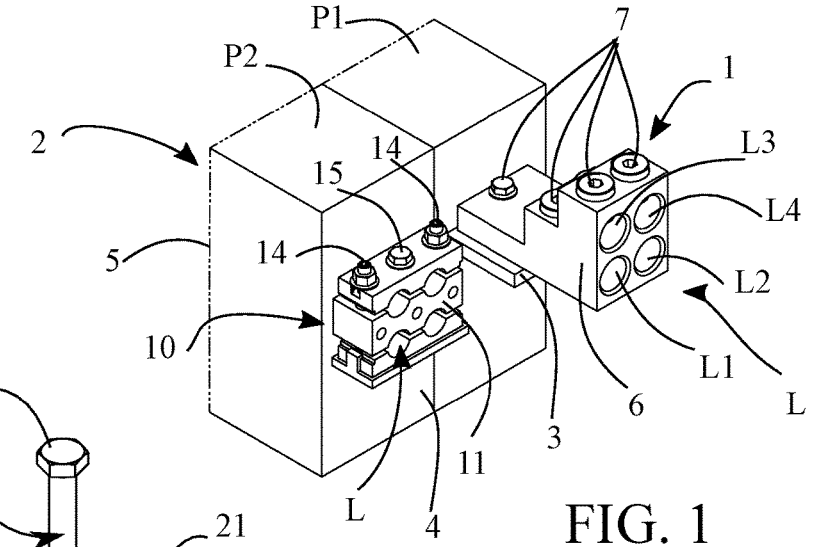
FIG. 1
FIG. 2
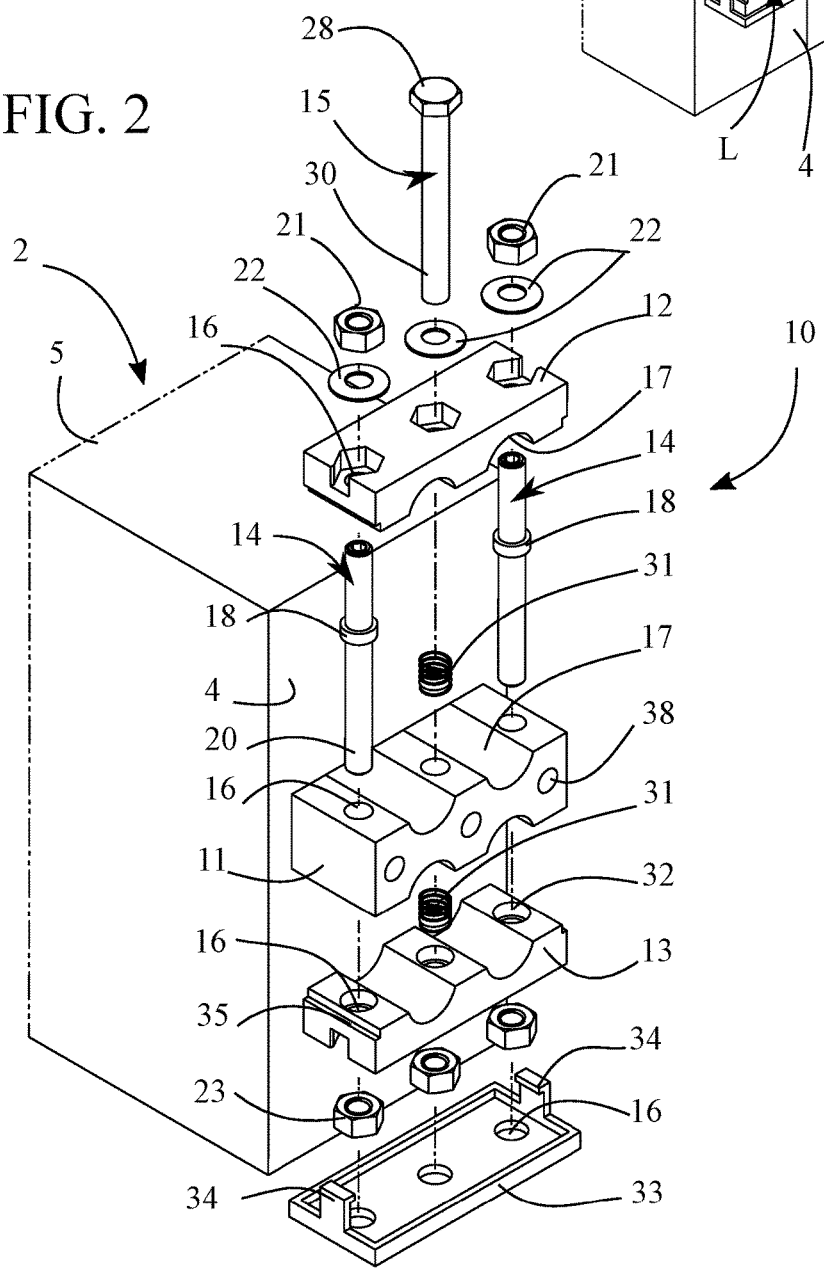
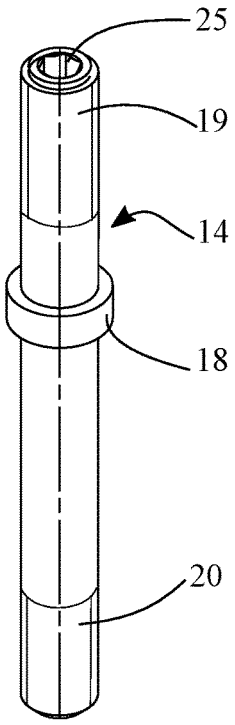
FIG. 3

FIG. 10
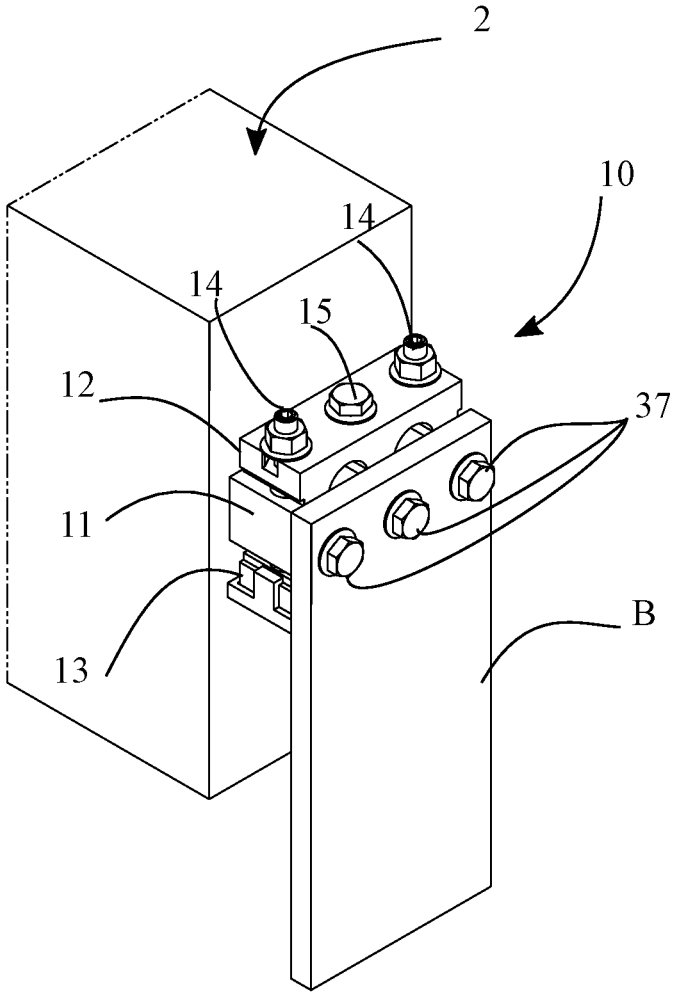
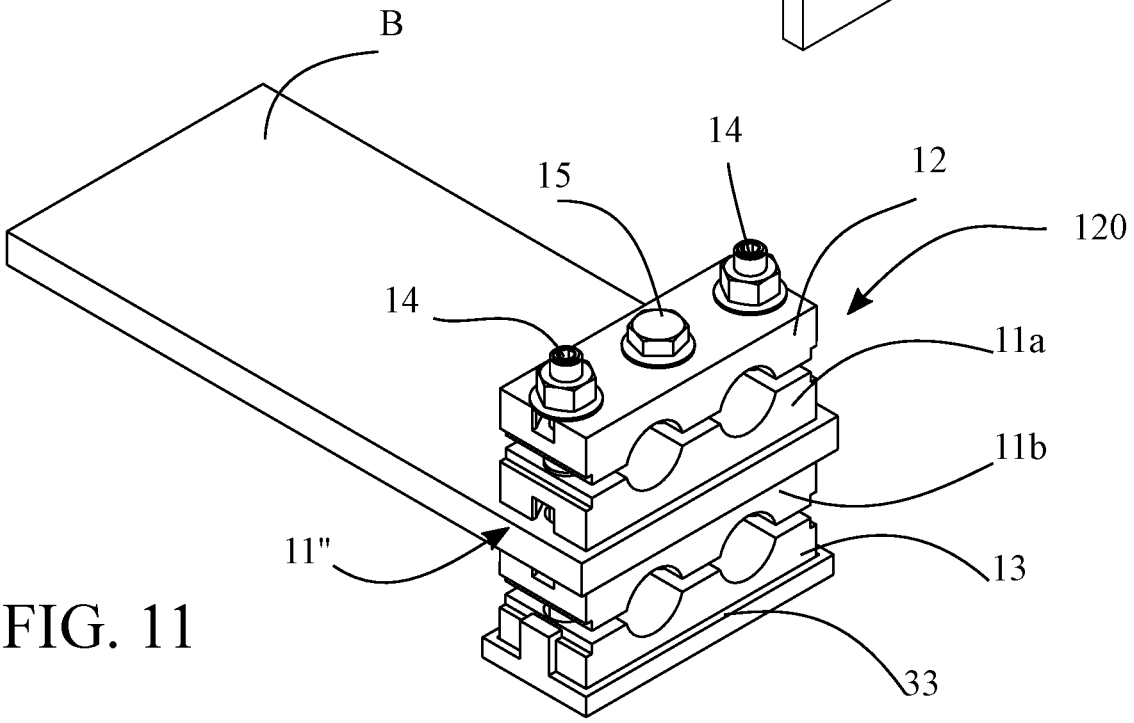
FIG. 11

FIG. 14
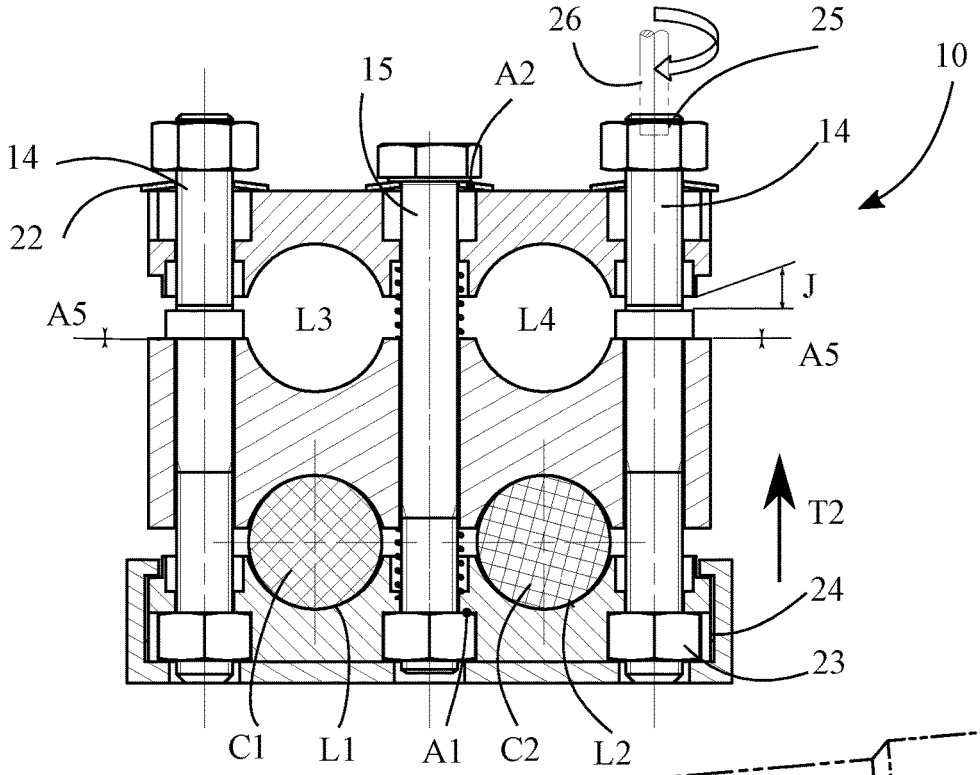
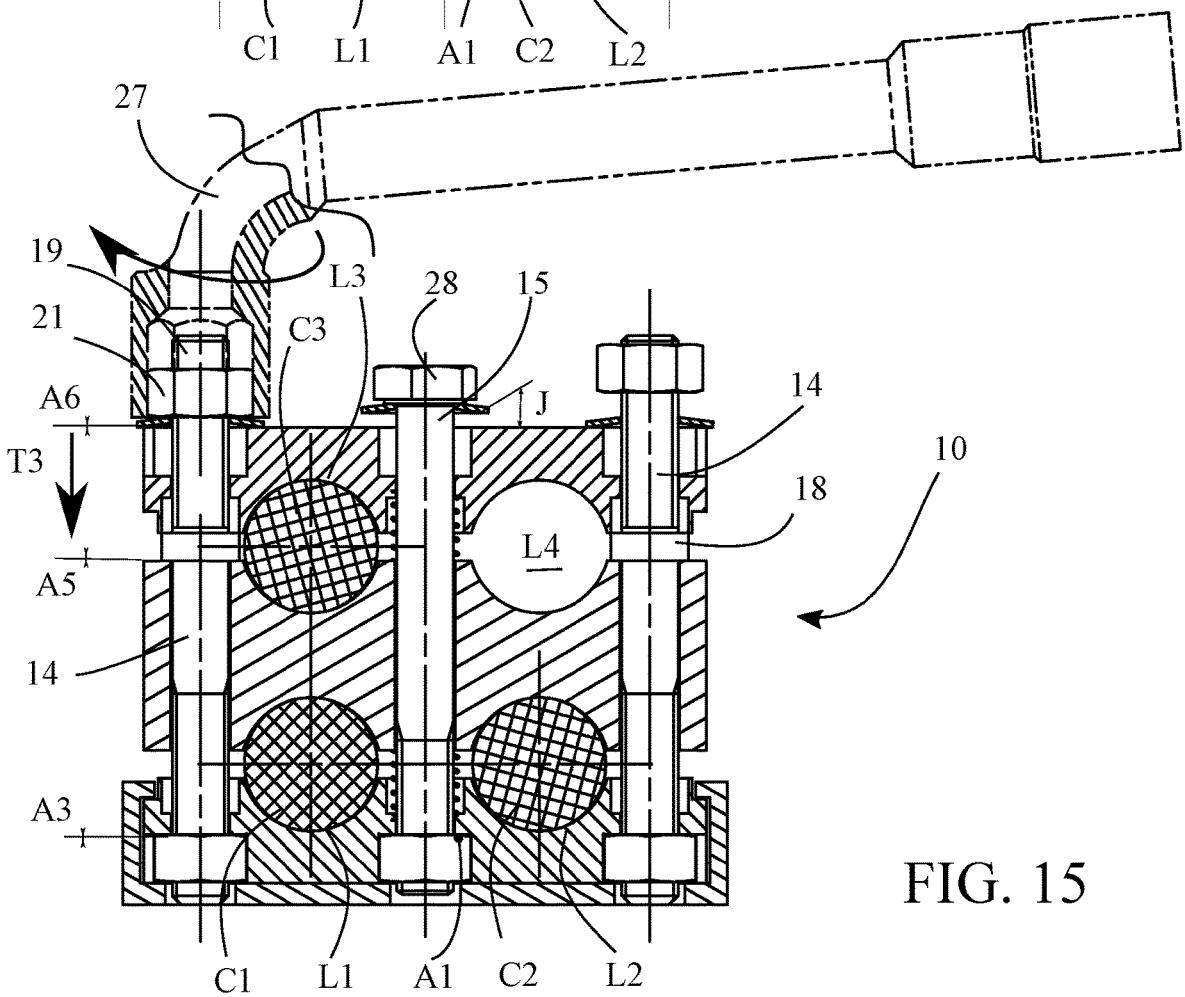
FIG. 15

ELECTRICAL CONNECTION DEVICE FOR AN ELECTRICAL APPARATUS AND CONNECTION METHOD USING SAID DEVICE

TECHNICAL FIELD

The present invention relates to an electrical connection device for an electrical apparatus, this device comprising a connection pad and two attachment flanges, including an upper attachment flange and a lower attachment flange, arranged on either side of the connection pad and designed to attach at least one conductor to said connection pad.

The invention further relates to a connection method for an electrical apparatus, wherein at least one conductor is clamped to a connection pad by means of an attachment flange.

BACKGROUND ART

Electrical apparatuses, such as, for example, switches, circuit breakers and similar apparatuses, comprise external connection pads, which are coupled to internal electrical contacts. The connection pads project from the housing of said apparatuses via faces, to allow the connection of conductors thereto ensuring a current supply and a current discharge. In a standard manner, the connection pads are flat and an attaching hole passes therethrough. They are complemented by connection kits or accessories, inside which the exposed end of said conductors is attached. These accessories are superposed on said connection pads in order to be attached thereto via the through-hole. Depending on the power of the electrical apparatuses, a connection pad can receive a number of conductors greater than one and, for example equal to two, four or six, which can take on the form of cables with one or more strands, of identical or different diameters, or even flat busbars. In order to satisfy these different connection configurations, the operator must assemble different accessories, each of which is adapted to the conductor received thereby, these different accessories being superposed in a stepped design so as to be attached to said connection pad. This solution requires having sufficient overall dimensions in the electrical cabinets, on either side of the electrical apparatus, in order to receive the connection pads extended by said accessories superposed in a stepped design. For the purposes of illustration, at least 100 mm must be provided on either side, i.e. a total of at least 200 mm per electrical apparatus. Moreover, this solution has numerous drawbacks. The connection of each conductor in these accessories and the mounting of the accessories on each connection pad is tedious and time-consuming given the number of attachment screws that must be tightened. It creates ergonomy issues regarding access to the clamping screws. The clamping force is not the same depending on the type of conductor considered (single-strand cable, multi-strand cable, bar). The clamping must be periodically checked to compensate for accidental misadjustment caused by fatigue to the attachment members and by the vibrations resulting, for example, from a short-circuit.

Japanese patent No. S50 26388 U proposes a solution allowing a main conductor and two lateral conductors parallel to one another to be connected to the same connection pad, by means of two attachment flanges arranged on either side of the connection pad and each provided with dedicated clamping screws, i.e. a total of three screws to be tightened for three conductors, which does not fully solve the problem posed.

U.S. patent No. 2016/226159 A1 proposes a versatile solution for connecting two to eight conductors to the same connection pad, by means of two T-shaped attachment flanges arranged on either side of a T-shaped connection pad, and a single central pass-through clamping screw. This solution is attractive as regards the number of screws to be tightened, however it considerably complicates the placing of the conductors, which must be held in the connection device before and during the tightening of the single screw.

Chinese patents No 206 022 666 U and No 206 180 132 U disclose connection solutions with a limited number of conductors, which does not solve the problem posed.

To date, no ergonomic, operator-friendly and versatile solution exists for satisfying a wide range of connection configurations.

DISCLOSURE OF INVENTION

The present invention aims to overcome these drawbacks by proposing a novel connection device that is compact since it saves a large volume of space in electrical cabinets, ergonomic, operator-friendly, easy and fast to implement due to the small number of members to be screwed in place, versatile so as to be able to satisfy a plurality of connection configurations, multi-functional since it allows functionalities to be added, and reliable and secure thanks to automatic compensation of the clamping in the event of fatigue or vibrations.

For this purpose, the invention relates to a connection device of the type specified in the preamble, characterised in that each attachment flange comprises two parallel and open cavities, in that said connection pad comprises, on each of the faces thereof, two parallel and open cavities, opposite the cavities of said attachment flanges in order to delimit, between said cavities, four recesses for conductors, including two lower recesses and two upper recesses, and in that said clamping means are through and designed to pass through the assembly formed by superposition of the upper attachment flange, of the connection pad, and of the lower attachment flange, and comprise a support abutment arranged between the connection pad and one of the attachment flanges such that said clamping means enable the tightening of at least the two lower recesses to be differentiated from that of the two upper recesses, or vice-versa.

In a first embodiment, the pass-through clamping means can comprise a single central tie rod. In such a case, the attachment flanges and the connection pad comprise a single central through-hole arranged between the parallel cavities, for receiving said single central tie rod, and said single central tie rod comprises said support abutment such that said clamping means enable the tightening of the two lower recesses to be differentiated from that of the two upper recesses.

In a second embodiment, the pass-through clamping means can comprise two lateral tie rods. In such a case, the attachment flanges and the connection pad comprise two through-holes arranged outside of the parallel cavities, for receiving one lateral tie rod each, and said lateral tie rods each comprise a support abutment such that said clamping means enable the tightening of the four recesses to be differentiated from one another.

The single central tie rod or the lateral tie rods advantageously comprise a shoulder forming said support abutment arranged between said connection pad and the upper attachment flange. They are preferably threaded at least over two end segments, including an upper segment and a lower segment, the lower segment engaging with a tapping provided in the lower flange, the upper segment engaging with a clamping nut, and said upper segment comprising an axial cavity for a tool.

According to the alternative embodiments, the pass-through clamping means further comprise a central rod parallel to said lateral tie rods. In such a case, the attachment flanges and the connection pad further comprise a third through-hole arranged between the parallel cavities, for receiving said central rod, and said central rod comprises a threading at least over a lower end segment designed to engage with a tapping provided in the lower attachment flange so as to tighten the four recesses simultaneously.

The tapping provided in the lower attachment flange can advantageously be constituted by a captive nut housed inside a corresponding hollowing of said lower attachment flange. In such a case, the connection device can comprise a cover attached to the lower attachment flange so as to retain said captive nut.

In one preferred embodiment, the connection device comprises return means arranged between the attachment flanges and the connection pad to hold said recesses open when the pass-through clamping means are not tightened. These return means can comprise two return members arranged about said single central tie rod or said central rod respectively between the connection pad and each of the attachment flanges. They can comprise four return members arranged in pairs about lateral tie rods respectively between the connection pad and each of the attachment flanges. Finally, they can comprise a single return member arranged about the central rod between the attachment flanges and passing freely through the connection pad.

Preferably, at least the upper attachment flange comprises a spot face, the depth whereof corresponds at least to the thickness of said support abutment or of said compressed return member.

According to the alternative configuration embodiments of the connection device, the connection pad can be made in one piece or in two pieces that are symmetrical relative to a median plane parallel to the attachment flanges, including an upper piece and a lower piece, each comprising two of the four parallel cavities. In this configuration, the connection pad can be designed to receive, between the two pieces thereof, a flat busbar.

In order to achieve the goal set, the invention further relates to an electrical apparatus comprising an electrical connection device as defined hereinabove wherein the connection pad forms an integral part of said electrical apparatus.

The purpose of the invention is then achieved by a connection method, for which a first connection device is used, the pass-through clamping means whereof comprise a single central tie rod, and wherein the following steps are carried out in chronological order to connect four conductors:

- a first conductor is positioned inside one of the lower recesses, referred to as a first recess,
- a second conductor is positioned inside the other lower recess, referred to as a second recess,
- the single central tie rod is screwed by means of a first tool engaged with the axial cavity, in order to cause the lower attachment flange to move closer to the connection pad and clamp only said first and second conductors inside said first and second recesses,
- a third conductor is positioned inside one of the upper recesses, referred to as a third recess,
- a fourth conductor is positioned inside the other upper recess, referred to as a fourth recess,
- the central tie rod is screwed only by means of a second tool engaged with the clamping nut, in order to cause the upper attachment flange to move closer to the connection pad and clamp only the third and fourth conductors inside said third and fourth recesses.

The purpose of the invention is also achieved by a connection method, for which a second connection device is used, the pass-through clamping means whereof comprise two lateral tie rods, and wherein the following steps are carried out in chronological order to connect four conductors:

- a first conductor is positioned inside one of the lower recesses, referred to as a first recess,
- the lateral tie rod situated on the same side as the first recess is screwed by means of a first tool engaged with the corresponding axial cavity in order to cause the lower attachment flange to move closer to the connection pad on the same side as said first recess and clamp only said first conductor inside said first recess,
- a second conductor is positioned inside the other lower recess, referred to as a second recess,
- the lateral tie rod situated on the same side as the second recess is screwed by means of said first tool engaged with the corresponding axial cavity in order to cause the lower attachment flange to move closer to the connection pad on the same side as said second recess and clamp only said second conductor inside said second recess,
- a third conductor is positioned inside one of the upper recesses, referred to as a third recess,
- the lateral tie rod situated on the same side as the third recess is screwed by means of a second tool engaged with the corresponding clamping nut in order to cause the upper attachment flange to move closer to the connection pad on the same side as said third recess and clamp only said third conductor inside said third recess,
- a fourth conductor is positioned inside the other upper recess, referred to as a fourth recess,
- the lateral tie rod situated on the same side as the fourth recess is screwed by means of said second tool engaged with the corresponding clamping nut in order to cause the upper attachment flange to move closer to the connection pad on the same side as said fourth recess and clamp only said fourth conductor inside said fourth recess.

In such a case, the connection method can be completed by screwing the central rod by means of a third tool formed by a torque wrench in order to simultaneously clamp the four conductors inside their recesses.

The invention allows the goals set to be achieved through the use of the connection device as defined hereinabove to connect a number of conductors of greater than or equal to one and less than or equal to six, these conductors being able to have different diameters between the lower recesses and the upper recesses.

This connection device can also be used to connect a busbar. It can also be used as a current distributor.

BRIEF DESCRIPTION OF DRAWINGS

The present invention and the advantages thereof will appear more clearly in the following description of a plurality of embodiments given for purposes of illustration only and not intended to limit the scope of the invention, with reference to the accompanying drawings, wherein:

FIG. 1 is a perspective view of an electrical apparatus equipped, on one of the poles thereof, with a connection device according to the prior art, and on the other pole thereof, with a connection device according to the invention, showing the differences between the two technologies, FIG. 2 is an exploded view of the connection device according to the invention in FIG. 1, FIG. 3 is a detailed view of a clamping tie rod of the connection device in FIG. 2, FIGS. 4 to 11 are perspective views of the connection device of the invention in different connection configurations detailed in the description, and FIGS. 12 to 17 are axial sectional views of the connection device of the invention showing the different steps of the method for connecting four conductors.

Figure 4:
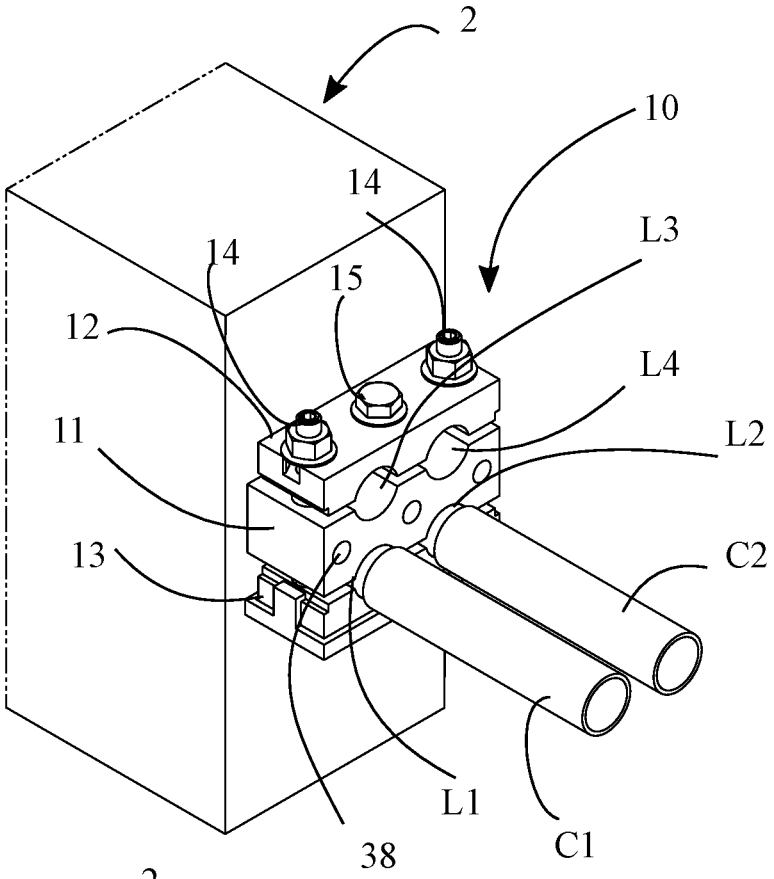

ILLUSTRATIONS OF THE INVENTION AND DIFFERENT MODES FOR CARRYING OUT THE INVENTION

In the example embodiments shown, identical elements or parts bear the same reference numerals.

FIG. 1 very clearly illustrates the design differences between a connection device 1 according to the prior art and a connection device 10 according to the invention, and the results obtained, in particular in terms of ergonomics regarding accessing the attachment screws, operator-friendliness as regards the number of attachment screws to be screwed in place, and overall dimensions in an electrical cabinet (not shown), in accordance with the drawbacks of the prior art and the advantages of the invention described hereinabove. These two connection devices 1, 10 are shown side-by-side and each equip a pole P1, P2 of an electrical apparatus 2 of the switch or circuit breaker type, or any other electrical apparatus requiring a current supply. They each comprise four recesses L1, L2, L3, L3 (jointly or individually referred to as L) allowing four conductors C1, C2, C3, C4 (not shown, jointly or individually referred to as C) to be connected.

The connection device 1 of the prior art comprises a planar connection pad 3 that projects from a wall 4 of the housing 5 of the electrical apparatus 2, and an accessory 6, in the form of a two-level staircase, fixed and attached to the connection pad 3 by an attachment screw 7. The accessory 6 comprises four recesses L, including two lower recesses L1, L2 at the first level which engage with two attachment screws 7, and two upper recesses L3, L4 at the second level which engage with two other clamping screws 7. The connection of four conductors C requires, as a result, screwing five attachment screws 7, the two of which at the lower level situated behind the upper level can be difficult to access.

The connection device 10 of the invention comprises a connection pad 11 which projects from a wall 4 of the housing 5 of the electrical apparatus 2, and two attachment flanges 12, 13, including one upper attachment flange 12 and one lower attachment flange 13, arranged on either side of the connection pad 11 and retained by pass-through clamping means. The terms "upper" and "lower" used in the description are relative to the vertical position of the device shown in the figures, which is not necessarily the real position of use thereof, and these terms must not be interpreted in a restrictive sense. In the examples shown, the attachment flanges 12 and 13 are made of identical parts, allowing the manufacture to be simplified, however this example embodiment is not limiting. The pass-through clamping means comprise, in the example shown, three threaded rods common to the two attachment flanges 12, 13, including two identical rods referred to as lateral tie rods 14 and a central rod 15, which are parallel, aligned, on the same level and thus readily accessible. The connection of four conductors C thus requires only three threaded rods to be screwed, which pass through the entirety of the connection device 10. Moreover, as explained below with reference to FIGS. 12 to 17, the connection device 10 of the invention is designed to ease the connection operation since it allows the clamping of the conductors C to be differentiated, recess by recess L, by selectively tightening the two lateral tie rods 14, then the central rod 15. The operator can thus install one conductor C after the other, by clamping or at least pre-clamping each conductor C in the recess L thereof before installing the next, thus reducing the tediousness of the operation. The example embodiment shown corresponds to the preferred form of the invention, however it is not the only possible form. More specifically, the two lateral tie rods 14, without the central rod 15, or a single central tie rod 14 could suffice and allow the invention to solve the problem posed.

The electrical connection device 10 shown in FIGS. 1, 2 and 4 to 10 is an equipment item that forms a part of an electrical apparatus 2, whereas the electrical connection device 120 shown in FIG. 11 is used alone, not connected to an electrical apparatus, such as a current distributor between, for example, an electrical power network and one or more electrical apparatuses 2. These examples show the flexibility of use of said device.

More particularly with reference to FIG. 2, which corresponds to an exploded view of the connection device 10 according to the invention in FIG. 1, the connection pad 11 is made in one piece, connected to the electrical apparatus 2, whereas the attachment flanges 12, 13 are removable pieces fixed to the connection pad 11. These three pieces (connection pad 11 and attachment flanges 12, 13) have an overall shape that forms a rectangular parallelogram, however they are not limited to this shape, and each comprise three through-holes 16 that are aligned and evenly distributed, preferentially smooth holes, to allow the lateral tie rods 14 and the central rod 15 to pass. The purpose of these pieces is to conduct the current and they are thus made of an electrically conducting material, such as, for example, aluminium, copper, or an alloy of these materials. The attachment flanges 12, 13 further comprise, on the face thereof facing the connection pad 11, two parallel and open cavities 17, and the connection pad 11 comprises, on each of the faces thereof facing the attachment flanges 12, 13, two identical parallel and open cavities 17 opposite the cavities 17 of the attachment flanges 12, 13, so as to delimit, between each pair of opposite cavities 17, a through-recess L for a conductor C, i.e. a total of four recesses L1, L2, L3, L4 for four conductors C1, C2, C3, C4, including two upper recesses L3, L4 and two lower recesses L1, L2 (see FIGS. 12 to 17). The number of recesses L provided is equal to four, which allows for a symmetrical top/bottom, left/right distribution, and a tightening that is differentiated recess by recess as explained hereinbelow. The length of the recesses L corresponds to the depth of the connection device 10 and defines the clamping length of the conductors C, which is standardised for a clamping torque determined as a function of the type of cable and material thereof. These cavities 17 have, in the example shown, an overall hollow semi-cylindrical shape, allowing substantially cylindrical recesses L to be formed, corresponding to the circular section of the majority of conductors C. Moreover, the diameter of these recesses L is self-adaptable and thus compatible with a plurality of diameters of the conductors C, since they are made of two opposing half-cylinders, the spacing between which can be adjusted by the pass-through clamping means. Of course, the semi-cylindrical shape of the recesses L is not limiting and extends to any other shape compatible with the shape of the conductors C to be connected. The cavities 17 can be coated in a material that promotes electrical contact, such as silver or a similar material for example. The cavities 17 can also comprise a structured surface state so as to increase the anchoring capacity thereof between the exposed metal part of the conductor C and the recess L during clamping so as to prevent the conductor C from being extracted from the recess L under traction. This structured surface state can be produced by a raised portion obtained by striae, a grid pattern, bumps, or any other design having the same technical effect.

The purpose of the pass-through clamping means is to hold the attachment flanges 12, 13 on the connection pad 11 on the one hand in a passive position wherein the recesses L are open and empty (see FIGS. 1, 8, 10, 11 and 12), and on the other hand in an active position wherein the recesses L are closed on conductors C by means of a sufficient clamping force for securing the conductors C to the connection device 10. This clamping force is normally adjusted to a standardised value, for example using a torque wrench.

The lateral tie rods 14 of the clamping means, an example whereof is shown in detail in FIG. 3, comprise a cylindrical rod provided with a shoulder between the lower and upper ends thereof, this shoulder forming a support abutment 18 designed to be arranged between the connection pad 11 and the upper attachment flange 12 in the example shown, or between the connection pad 11 and the lower attachment flange 13 if the lateral tie rods 14 are inserted into the connection device 10 from bottom to top. The lateral tie rods 14 are threaded at least over the two end segments thereof, including an upper segment 19 and a lower segment 20, however this example is not limiting, whereby these threadings can extend as far as the support abutment 18. The upper segment 19 is designed to engage with a clamping nut 21 via a washer 22, which can advantageously be a resilient washer of the Belleville type, allowing for automatic compensation of the dimensional changes caused by thermal expansion. The lower segment 20 engages with either a tapping provided in the lower flange 13 (not shown), or with a captive nut 23 housed inside a corresponding hollowing 24 (see FIG. 12) of the lower attachment flange 13, in accordance with the example shown. The upper segment 19 further comprises an axial cavity 25 designed to engage with a first tool 26 (see FIG. 13), provided, for example, with a male six-point tip of the Allen key type, however this example is not limiting. The clamping nut 21 is designed to engage with a second tool 27 (see FIG. 15), provided, for example, with a female six-point tip, however this example is not limiting. More specifically, the shape of the axial cavity 25 and that of the clamping nut 21 are not restricted to those shown and can encompass any other shape adapted to the tools used.

The central rod 15 of the clamping means (FIG. 2) comprises a cylindrical rod terminating, at the upper end thereof, by a head 28 which bears on the upper flange 12 via a washer 22, preferably a resilient washer of the Belleville type, as for the lateral tie rods 14. The head 28 is, for example, hexagonal so as to engage with a third tool 29 provided with a female six-point tip, however this example is not limiting. It is threaded at least over the lower segment 30 thereof, however this example is not limiting, and this threading can extend as far as the head 28. The lower segment 30 engages with either a tapping provided in the lower flange 13 (not shown), or with a captive nut 23 housed inside a corresponding hollowing 24 (see FIG. 12) of the lower attachment flange 13, as for the lateral tie rods 14.

The connection device 10 according to the invention further comprises return means arranged between the attachment flanges 12, 13 and the connection pad 11 in order to automatically hold the recesses L open when the clamping means are not tightened (see FIGS. 1, 8, 10, 11 and 12 to 15), thus facilitating the insertion of the conductors C into said recesses L. The return means as shown in the figures comprise two return members 31, of the helical spring type, this example being non-limiting, arranged about the central rod 15 respectively between the connection pad 11 and each of the attachment flanges 12, 13 (FIG. 2). The two return members 31 can be replaced by a single return member arranged about the central rod 15 between the two attachment flanges 12, 13, and passing freely through the connection pad 11. They can also be replaced by four return members arranged in pairs about the lateral tie rods 14 respectively between the connection pad 11 and each of the attachment flanges 12, 13. The attachment flanges 12, 13 each comprise three spot faces 32, the depth whereof corresponds at least to the thickness of the support abutment 18 and of the compressed return member 31 to prevent a hyperstatic assembly from being produced, which would prevent the proper clamping of the correctors C inside the recess L thereof. The two lateral spot faces 32 of the upper attachment flange 12 are provided so as to completely house the support abutment 18 of the lateral tie rods 14 when they are screwed and when the upper recesses L3 and L4 are empty (see FIG. 4), allowing the upper attachment flange 12 to bear against the connection pad 11.

The central spot face 32 of the upper attachment flange 12 and lower attachment flange 13 is intended to axially position the corresponding return member 31, and to completely house said return member 31 in the same respect as the support abutment 18 when the upper recesses L3, L4 are empty. In order to facilitate the manufacture of the parts constituting the connection device 10 of the invention, reduce costs and simplify management, the attachment flanges 12, 13 are identical and interchangeable. This is why they comprise the same hollowings 24 and the same spot faces 32, even if they are of no use depending on the position in which they are used. Similarly, the connection pad 11 is symmetrical relative to a median plane parallel to said attachment flanges 12, 13 so as to be reversible.

The connection device 10 further comprises a cover 33 attached to the lower attachment flange 13 so as to retain the captive nuts 23 (FIG. 2). This cover 33 comprises three smooth through-holes 16 in the continuation of the through-holes 16 of the attachment flanges 12, 13 and of the connection pad 11 in order to receive the end of the lower segments 20, 30 of the lateral tie rods 14 and of the central rod 15 (see FIG. 12). The cover 33 is attached to the lower attachment flange 13 by two opposing clips 34 engaged with an outer rim 35 provided on the corresponding faces of said flange. Of course, any other reversible attachment means can be suitable.

Figure 5:
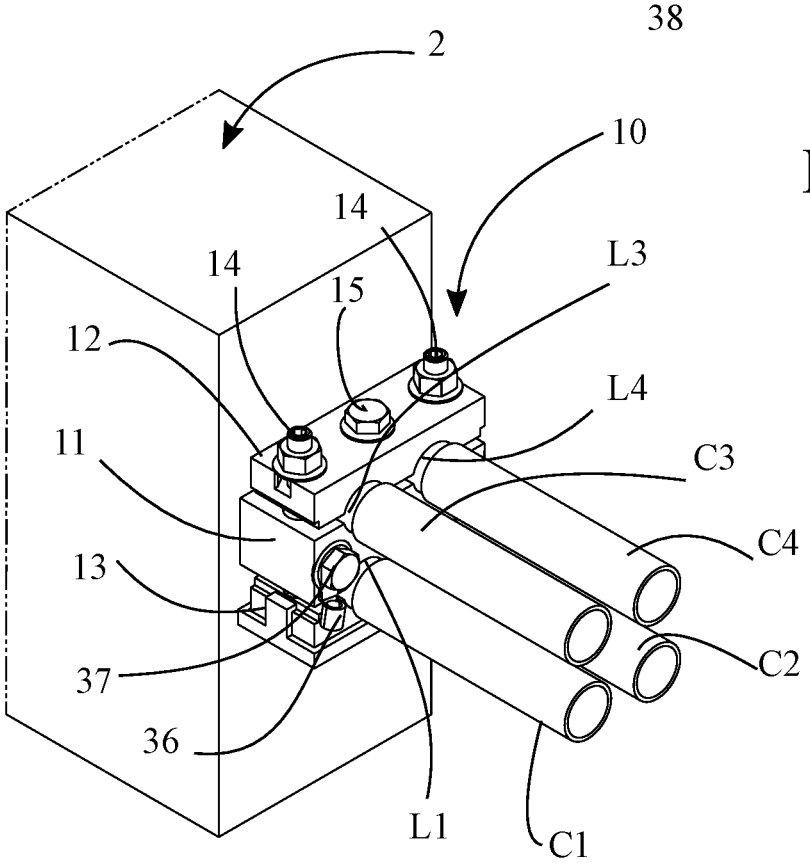
Figure 6:
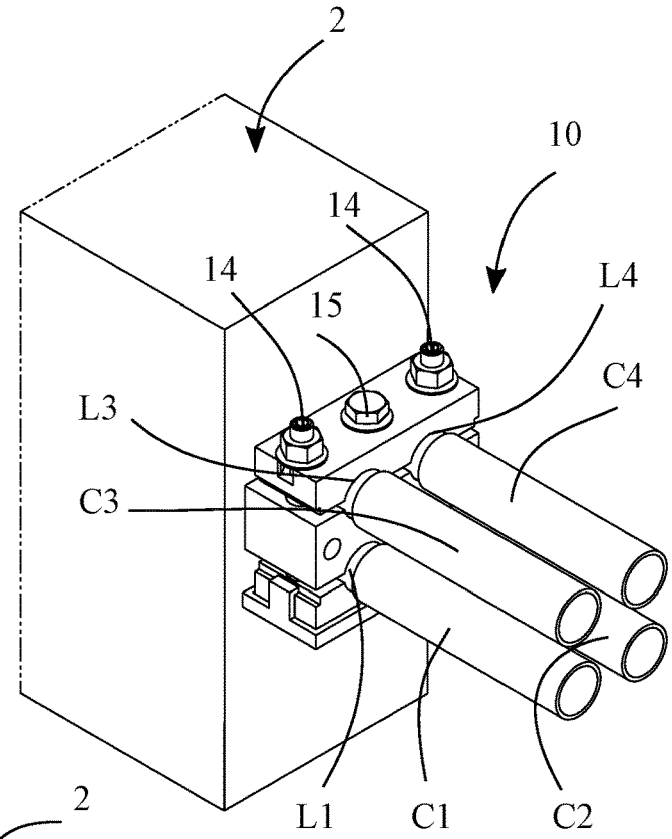

FIGS. 4 to 11 illustrate some examples of connection configurations allowed by the connection device 10 of the invention to show the versatility of this device and the possible variations, however these examples are not limiting. FIG. 4 shows the connection of only two conductors C1, C2 of the same diameter, in the two lower recesses L1, L2, leaving the upper recesses L3, L4 vacant. This configuration shows that after tightening the lateral tie rods 14 and the central rod 15, the upper attachment flange 12 bears such that it is tight against the connection pad 11 whereas the lower attachment flange 13 is tight against the exposed ends of the conductors C1, C2, leaving play with the connection pad 11. FIG. 5 shows the connection of four conductors C1, C2, C3, C4 of the same diameter, in the four recesses L1, L2, L3, L4. It further shows a voltage tap 36 attached by a screw 37 inside a threaded hole 38 provided in the front face of the connection pad 11. For this purpose, the connection pad 11 comprises three threaded holes 38 parallel to one another, perpendicular to the through-holes 16, including two lateral holes and one central hole. FIG. 6 shows the connection of four conductors C1, C2, C3, C4 inside the four recesses L1, L2, L3, L4, the two upper conductors C3, C4 having a diameter that is less than that of the lower conductors C1, C2. This configuration shows that the displacement of the attachment flanges 12, 13 relative to the connection pad 11 can be different so as to adapt the section of the recesses L to the diameter of the conductors C. In the preceding figures, the conductors C enter facing the electrical apparatus 2 parallel to the axis of the recesses L of the connection device 10.

Figure 7:
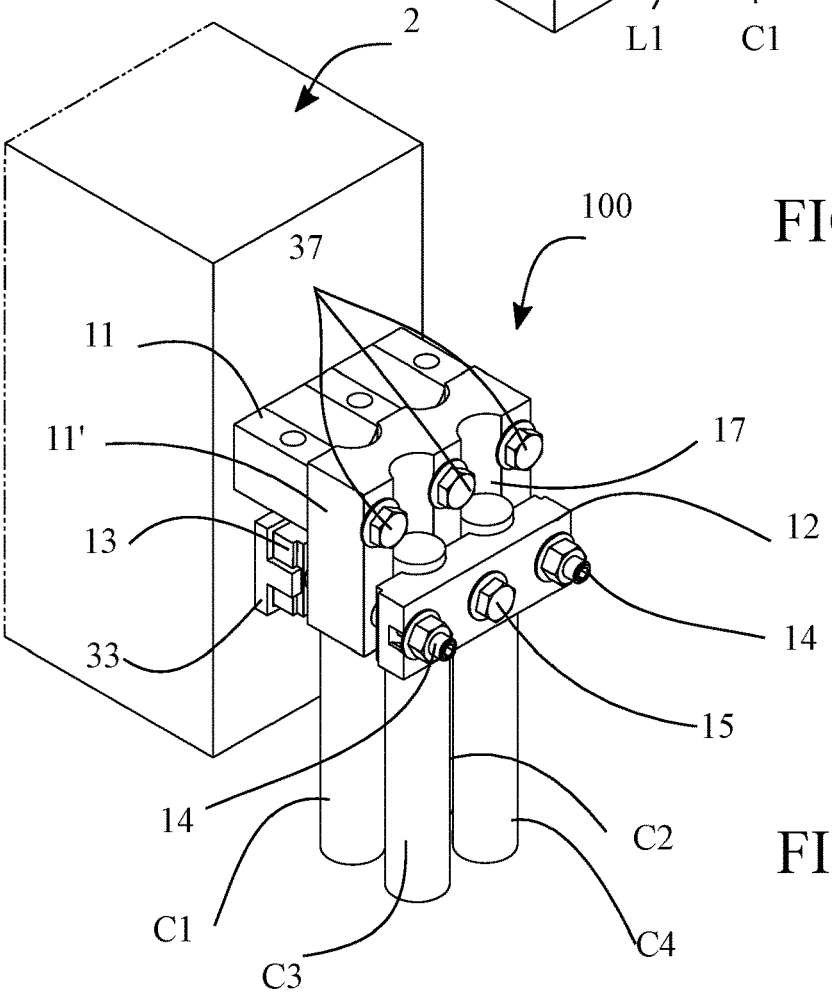

FIG. 7 shows the case whereby the conductors C enter from the bottom, perpendicularly to the axis of the recesses L of the connection device 10. The same connection device 10 is not used in such a case, instead a right-angle connection device 100 is designed, by mounting, on the connection pad 11 leaving the electrical apparatus 2, an extended connection pad 11' oriented perpendicularly and attached by three screws 37 in the three threaded holes 38 of the connection pad 11. The attachment of the four conductors C1, C2, C3, C4 is then carried out in the same manner shown in FIG. 5 by means of the attachment flanges 12, 13 fixed to the extended connection pad 11' with the lateral tie rods 14 and the central rod 15.

Figure 8:
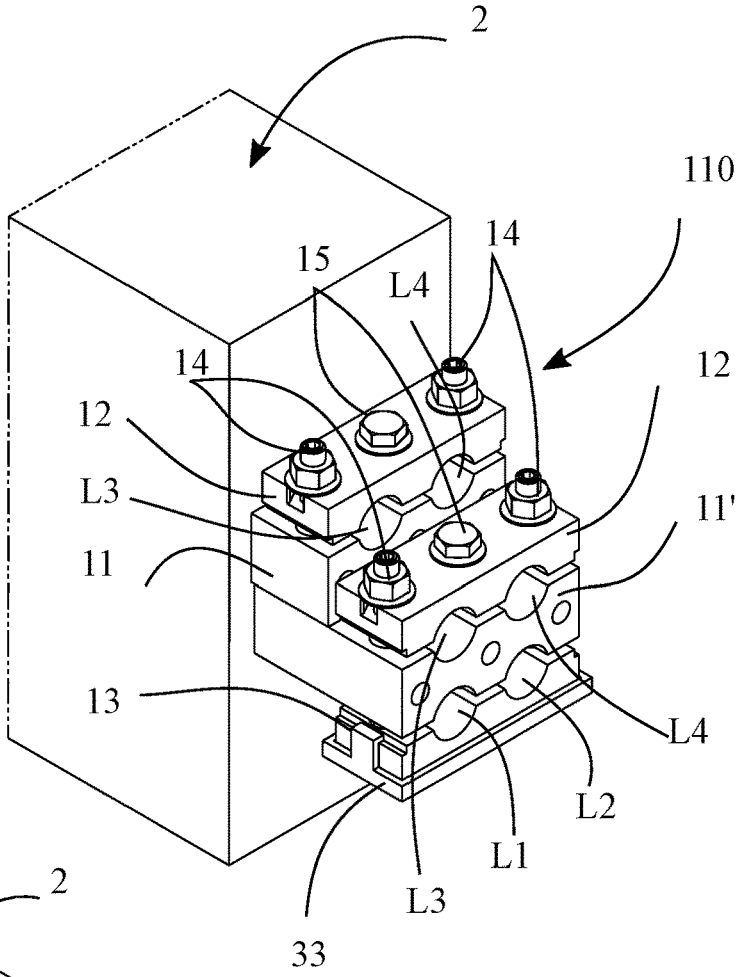
Figure 9:
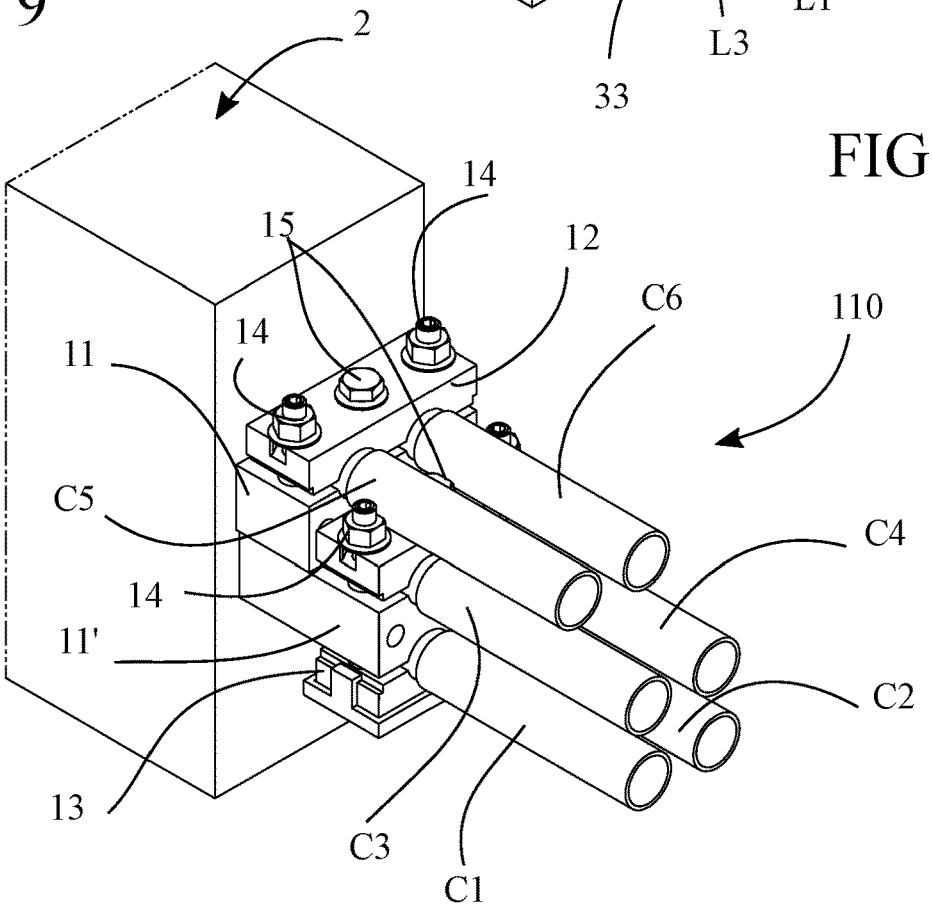

FIG. 8 shows an alternative configuration embodiment allowing more than four conductors to be connected, for example six conductors C1, C2, C3, C4, C5 and C6. The same connection device 10 is not used in such a case, instead an expanded connection device 110 is designed, by mounting, on the connection pad 11 leaving the electrical apparatus 2, an extended connection pad 11' oriented in parallel and attached to the upper attachment flange 12 by three threaded rods 14, 15, which can be constituted by three rods 15, in tappings or captive nuts provided in the extended connection pad 11' (but not shown). The attachment of the first four conductors C1, C2, C3, C4 is carried out in the same manner shown in FIG. 5 by means of the attachment flanges 12, 13 fixed to the extended connection pad 11' with the lateral tie rods 14 and the central rod 15. The attachment of the two additional conductors C5, C6 is then carried out inside the two upper recesses L3, L4 defined between the connection pad 11 and the upper attachment flange 12 with the corresponding two lateral tie rods 14 and the central rod 15.

In the configuration shown in FIG. 10, the electrical apparatus 2 is not powered by conductors C in the form of cables, but by a busbar B. In such a case, the connection device 10 is used, in the closed position, i.e. the lateral tie rods 14 and the central rod 15 are screwed to close the recesses L, and the corresponding end of the busbar B is attached by three screws 37 in the three threaded holes 38 in the front face of the connection pad 11. The busbar B can have a different width to that of the connection device 10.

FIG. 11 shows a connection device 120 used alone, not connected to an electrical apparatus, to form a current distributor, without additional parts. In this configuration, the connection pad 11" is made in two pieces 11*a*, 11*b* that are symmetrical relative to a median plane parallel to the attachment flanges 12, 13, including an upper piece 11*a* and a lower piece 11*b*, each comprising two of the four parallel cavities 17. In the example shown, the two pieces 11*a*, 11*b* are identical to the attachment flanges 12, 13, simplifying manufacture, however this example embodiment is not limiting. The connection pad 11" can thus receive, between the two pieces 11*a*, 11*b* thereof, the end of a flat busbar B. The latter must be provided with three through-holes facing the through-holes 16 for passing the lateral tie rods 14 and the central rod 15 through the assembly formed by the upper attachment flange 12, the upper piece 11*a*, the busbar B, the lower piece 11*b* and the lower attachment flange 13.

Figure 12:
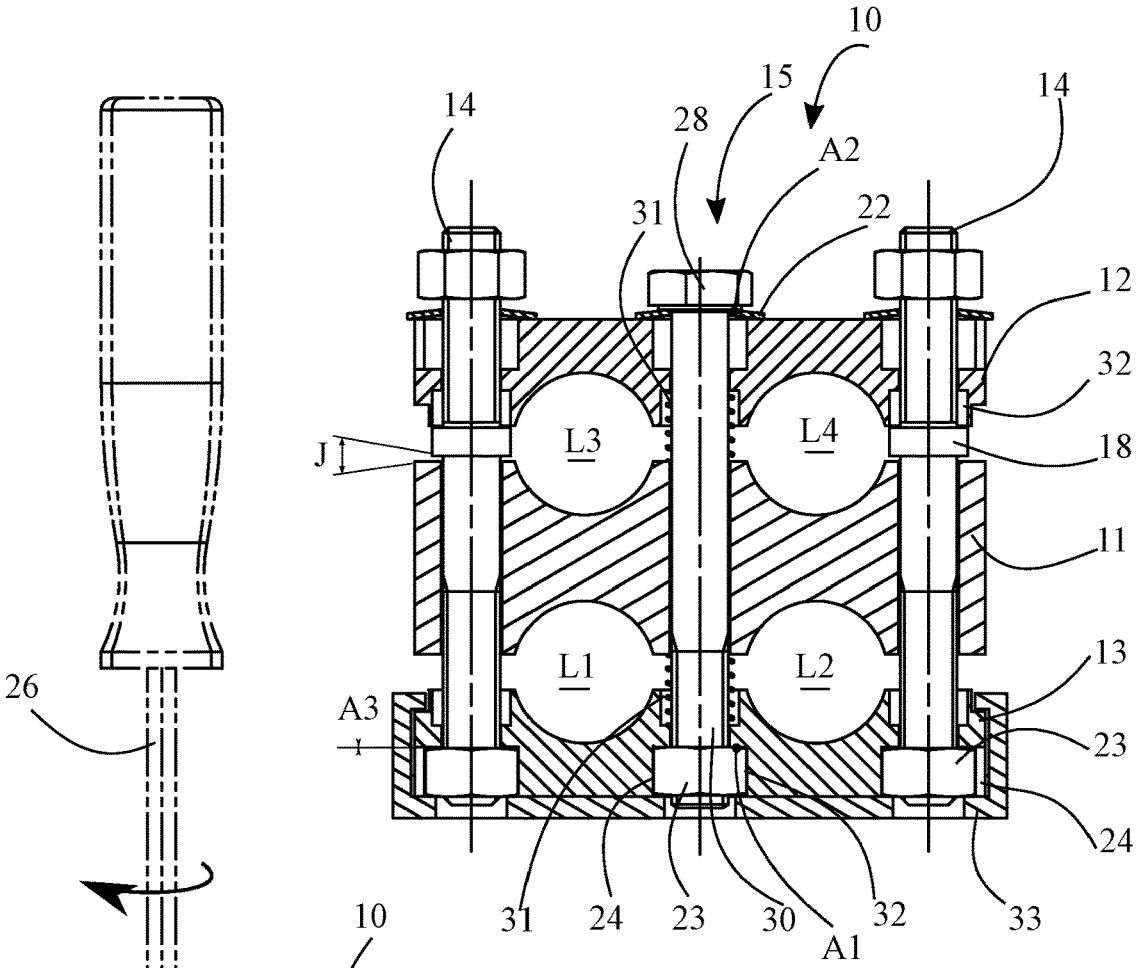

FIGS. 12 to 17 are axial sectional views of the connection device 10 of the invention showing the different steps of the connection method applied to four conductors C1, C2, C3, C4. In FIG. 12, the connection device 10 is empty and the four recesses L1, L2, L3, L4 are open thanks to the working of the return members 31 which tend to distance the attachment flanges 12, 13 from the connection pad 11. In this position, the assembly is retained by the central rod 15 and the two opposing supports A1, A2 thereof, respectively formed by the captive nut 23 in contact with the bottom of the hollowing 24 of the lower attachment flange 13, and by the head 28 thereof in contact with the upper face of the upper attachment flange 12 via the washer 22. The lateral tie rods 14 are inactive and each is retained by the support A3 thereof formed by the captive nut 23 thereof in contact with the bottom of the hollowing 24 of the lower attachment flange 13.

Figure 13:
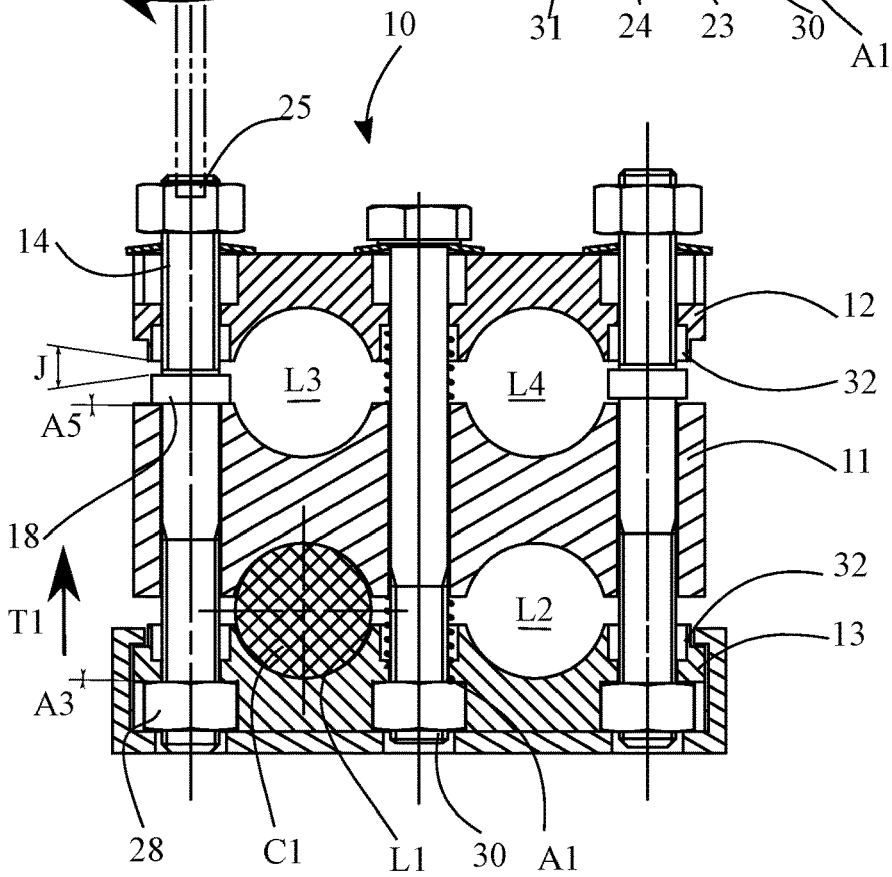

FIG. 13 shows the connection of a first conductor C1 in a first recess L1 situated in the lower part of the device. Using a first tool 26 engaged with the axial cavity 25 of the lateral tie rod 14 situated on the left in the figure, the operator screws the lateral tie rod 14 into the captive nut 23 thereof, which causes the support abutment 18 to descend until coming into contact with the connection pad 11, creating a new support A5, causing the lower attachment flange 13 to rise towards the connection pad 11 according to the arrow T1 until it clamps the conductor C1 inside the recess L1 thereof. During this first clamping step, and thanks to the design of the device, the lower attachment flange 13 can move slightly in the clockwise direction about the support A1 thereof with the central rod 15. This results in a differentiated tightening, which is concentrated at the first recess L1 only, the other recesses L2, L3, L4 remaining open.

FIG. 14 shows the connection of a second conductor C2 in a second recess L2 situated in the lower part of the device. Using the same first tool 26 engaged with the axial cavity 25 of the lateral tie rod 14 situated in this instance on the right in the figure, the operator screws the lateral tie rod 14 into the captive nut 23 thereof, which causes the support abutment 18 to descend until coming into contact with the connection pad 11, creating the same support A5 as above, causing the lower attachment flange 13 to rise towards the connection pad 11 according to the arrow T2 until it clamps the conductor C2 inside the recess L2 thereof. During this second clamping step, and thanks to the design of the device, the lower attachment flange 13 moves slightly in the anti-clockwise direction about the support A1 thereof with the central rod 15. This results in a differentiated tightening, which in this instance is concentrated at the second recess L2 only, the first recess L1 remaining tightly closed and the two other recesses L3, L4 remaining open.

FIG. 15 shows the connection of a third conductor C3 in a third recess L3 situated in the upper part of the device. Using a second tool 27 engaged with the clamping nut 21 of the lateral tie rod 14 situated on the left in the figure, the operator screws the clamping nut 21 onto the upper segment 19 of the lateral tie rod 14, which descends until coming into contact with the upper attachment flange 12 via the washer 22 thereof, forming a new support A6, then drives the upper attachment flange 12 with it towards the connection pad 11 according to the arrow T3 until it clamps the conductor C3 inside the recess L3 thereof. During this third clamping step, and thanks to the design of the device, the upper attachment flange 13 moves slightly in the anti-clockwise direction about the central rod 15 relative to the through-hole 16 thereof, eliminating the support A2 of the head 28, generating a differentiated tightening at the third recess L3 only, the first and second recesses L1, L2 remaining tightly closed, and the final recess L4 remaining open.

Figure 16:
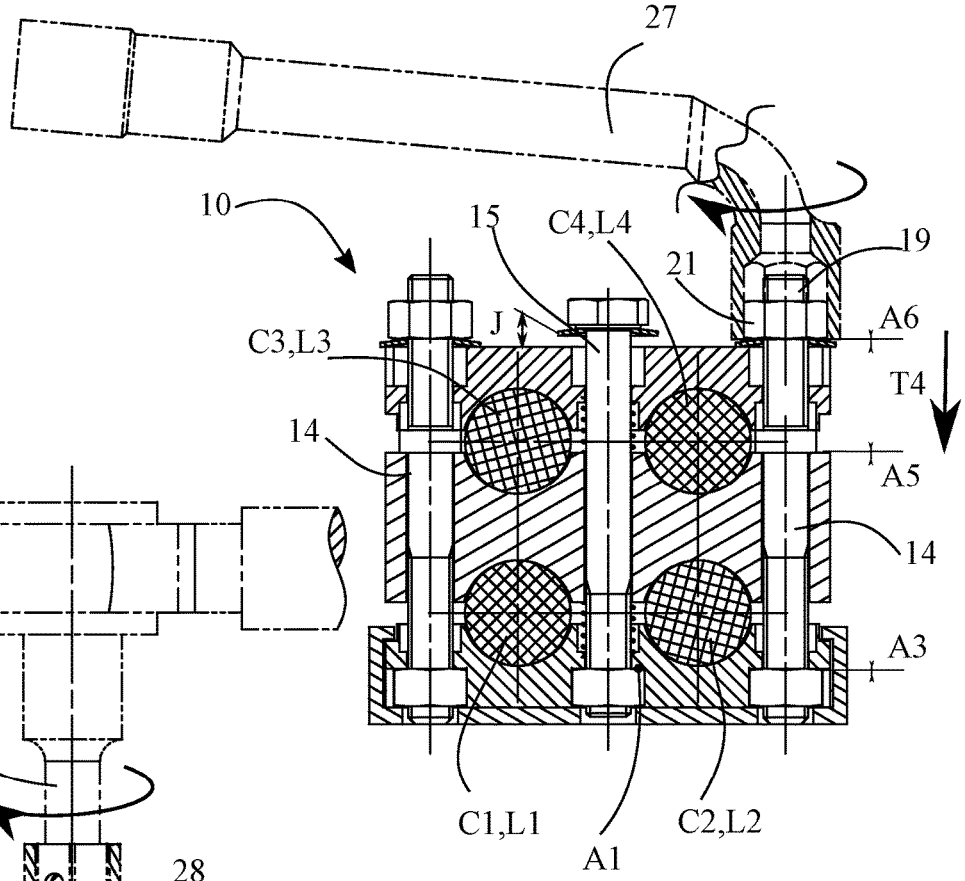

FIG. 16 shows the connection of a fourth conductor C4 in a fourth recess L4 situated in the upper part of the device. Using the same second tool 27 engaged with the clamping nut 21 of the lateral tie rod 14 situated on the right in the figure, the operator screws the clamping nut 21 onto the upper segment 19 of the lateral tie rod 14, which descends until coming into contact with the upper attachment flange 12 via the washer 22 thereof, forming the same support A6, then drives the upper attachment flange 12 with it towards the connection pad 11 according to the arrow T4 until it clamps the conductor C4 inside the recess L4 thereof. During this fourth clamping step, and thanks to the design of the device, the upper attachment flange 13 moves slightly in the clockwise direction about the central rod 15 relative to the through-hole 16 thereof, generating a differentiated tightening at the fourth recess L4 only, the other three recesses L1, L2, L3 remaining tightly closed.

Figure 17:
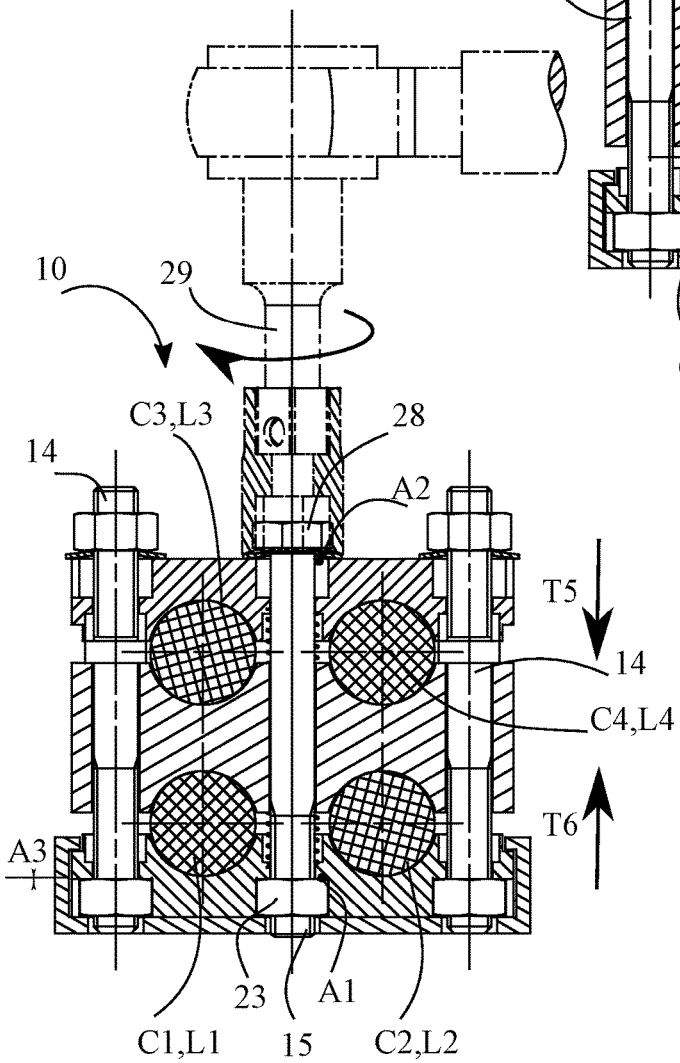

Thus, the connection device 10 allows each conductor C1, C2, C3, C4 to be individually clamped or pre-clamped inside the recess L1, L2, L3, L4 thereof, and allows this assembly to be completed by an overall safety tightening operation in a final step of the connection method according to the invention shown in FIG. 17. Using a third tool 29 engaged with the head 28 of the central rod 15, the operator screws the central rod 15 into the captive nut 23 thereof, which descends until coming into contact with the upper attachment flange 12 via the washer 22 thereof, reforming the initial support A2, and causes the lower attachment flange 13 to rise towards the upper attachment flange 12, which procures a simultaneous, controlled and uniform clamping of the four conductors C1, C2, C3, C4, the force thereof can be determined by the torque wrench of the third tool 29.

It is clear from the above description that the invention allows the set goals to be achieved, i.e. it procures a connection method that is simple, practical, ergonomic, efficient and operator-friendly, that is capable of reducing handling operations and servicing times for the operator, for an optimised result in terms of the quality of the connection, the durability of this connection, the compactness of the device and a multitude of possible connection options. The present invention is not limited to the example embodiments described herein, but encompasses all amendments and alternatives that are clear to a person skilled in the art.

The invention claimed is:

1. An electrical connection device for an electrical apparatus, said device comprising a connection pad and two attachment flanges, including an upper attachment flange and a lower attachment flange, arranged on either side of the connection pad and adapted to attach at least one conductor to said connection pad by clamping means, each of said attachment flanges comprising two parallel and open cavities, said connection pad comprising, on each face thereof, two parallel and open cavities, opposite the cavities of said attachment flanges in order to delimit, between said cavities, four recesses for said conductors, including two lower recesses and two upper recesses, and said clamping means being through and adapted to pass through an assembly formed by superposition of the upper attachment flange, of the connection pad, and of the lower attachment flange, characterized in that said clamping means comprise a single central tie rod or two lateral tie rods, each comprising a shoulder forming a support abutment arranged between said connection pad and one of the attachment flanges, in that said clamping means are threaded at least over two end segments, including an upper segment and a lower segment, in that the lower segment engages with a tapping provided in the lower flange, in that the upper segment engages with a clamping nut, and in that said upper segment comprises an axial cavity for a tool, such that said clamping means enable tightening of the two lower recesses to be differentiated from tightening of the two upper recesses, or tightening of the four recesses to be differentiated from one another.

2. The electrical connection device according to claim 1, characterized in that said clamping means comprise a single central tie rod, in that the attachment flanges and the connection pad comprise a single central through-hole arranged between the parallel cavities for receiving said single central tie rod, and in that said single central tie rod comprises said support abutment such that said clamping means enable tightening of the two lower recesses to be differentiated from tightening of the two upper recesses.

3. The electrical connection device according to claim 1, characterized in that said clamping means comprise two lateral tie rods, in that the attachment flanges and the connection pad comprise two through-holes arranged outside of the parallel cavities, for receiving one lateral tie rod each, and in that said lateral tie rods each comprise a support abutment such that said clamping means enable the tightening of the four recesses to be differentiated from one another.

4. The electrical connection device according to claim 3, characterized in that said clamping means further comprise a central rod parallel to said lateral tie rods, in that the attachment flanges and the connection pad further comprise a third through-hole arranged between the parallel cavities, for receiving said central rod, and in that said central rod comprises a threading at least over a lower end segment adapted to engage with a tapping provided in the lower attachment flange so as to tighten the four recesses simultaneously.

5. The electrical connection device according to claim 1, characterized in that said tapping provided in the lower attachment flange is constituted by a captive nut housed inside a corresponding hollowing of said lower attachment flange.

6. The electrical connection device according to claim 5, further comprising a cover attached to the lower attachment flange so as to retain said captive nut.

7. The electrical connection device according to claim 1, further comprising return means arranged between the attachment flanges and the connection pad to hold said recesses open when the clamping means are not tightened.

8. The electrical connection device according to claim 7, characterized in that said return means comprise two return members arranged about said single central tie rod or said central rod respectively between the connection pad and each of the attachment flanges.

9. The electrical connection device according to claim 7, characterized in that said return means comprise four return members arranged in pairs about the lateral tie rods respectively between the connection pad and each of the attachment flanges.

10. The electrical connection device according to claim 7, characterized in that said return means comprise a single return member arranged about the central rod between the attachment flanges and passing freely through the connection pad.

11. The electrical connection device according to claim 7, characterized in that at least the upper attachment flange comprises a spot face, a depth whereof corresponds at least to a thickness of said support abutment or of said return member.

12. The electrical connection device according to claim 1, characterized in that the connection pad is made in one piece.

13. The electrical connection device according to claim 1, characterized in that the connection pad is made in two pieces that are symmetrical relative to a median plane parallel to the attachment flanges, including an upper piece and a lower piece, each comprising two of the four parallel cavities, and in that said connection pad is adapted to receive, between the two pieces thereof, a flat busbar.

14. An electrical apparatus, comprising an electrical connection device according to claim 1 and characterized in that said connection pad forms an integral part of said electrical apparatus.

15. A method for connecting conductors in an electrical connection device according to claim 1, characterized in that the connection device whose clamping means comprise a single central tie rod is used, and in that the following steps are carried out in chronological order to connect four conductors:

- a first conductor is positioned inside one of the lower recesses, referred to as a first recess,
- a second conductor is positioned inside the other lower recess, referred to as a second recess,
- the single central tie rod is screwed by means of a first tool engaged with the axial cavity, in order to cause the lower attachment flange to move closer to the connection pad and clamp only said first and second conductors inside said first and second recesses,
- a third conductor is positioned inside one of the upper recesses, referred to as a third recess,
- a fourth conductor is positioned inside the other upper recess, referred to as a fourth recess,
- the central tie rod is screwed only by means of a second tool engaged with the clamping nut, in order to cause the upper attachment flange to move closer to the connection pad and clamp only said third and fourth conductors inside said third and fourth recesses.

16. A method for connecting conductors in an electrical connection device according to claim 1, characterized in that the connection device whose clamping means comprise two lateral tie rods is used, and in that the following steps are carried out in chronological order to connect four conductors:

- a first conductor is positioned inside one of the lower recesses, referred to as a first recess,
- the lateral tie rod situated on the same side as the first recess is screwed by means of a first tool engaged with the corresponding axial cavity in order to cause the lower attachment flange to move closer to the connection pad on the same side as said first recess and clamp only said first conductor inside said first recess,
- a second conductor is positioned inside the other lower recess, referred to as a second recess,
- the lateral tie rod situated on the same side as the second recess is screwed by means of said first tool engaged with the corresponding axial cavity in order to cause the lower attachment flange to move closer to the connection pad on the same side as said second recess and clamp only said second conductor inside said second recess,
- a third conductor is positioned inside one of the upper recesses, referred to as a third recess,
- the lateral tie rod situated on the same side as the third recess is screwed by means of a second tool engaged with the corresponding clamping nut in order to cause the upper attachment flange to move closer to the connection pad on the same side as said third recess and clamp only said third conductor inside said third recess,
- a fourth conductor is positioned inside the other upper recess, referred to as a fourth recess,
- the lateral tie rod situated on the same side as the fourth recess is screwed by means of said second tool engaged with the corresponding clamping nut in order to cause the upper attachment flange to move closer to the connection pad on the same side as said fourth recess and clamp only said fourth conductor inside said fourth recess.

17. The method for connecting conductors according to claim 16, characterized in that said method is completed by screwing the central rod by means of a third tool formed by a torque wrench in order to simultaneously clamp the four conductors inside their recesses.

18. Use of the electrical connection device according to claim 1 for connecting a number of conductors greater than or equal to one and less than or equal to six.

19. Use of the electrical connection device according to claim 18 for connecting conductors of different diameters between the lower recesses and the upper recesses.

20. Use of the electrical connection device according to claim 18, for further connecting a busbar.

21. Use of the electrical connection device according to claim 20, as a current distributor.

* * * * *